US009677377B2

(12) United States Patent
Miller et al.

(10) Patent No.: US 9,677,377 B2
(45) Date of Patent: Jun. 13, 2017

(54) FAILSAFE CONTROL SYSTEM FOR A SAFETY VALVE HAVING A CONDITION SENSING AND CHEMICAL INJECTION FEATURE

(71) Applicants: Wade A. Miller, Broken Arrow, OK (US); Brett C. Jones, Broker Arrow, OK (US)

(72) Inventors: Wade A. Miller, Broken Arrow, OK (US); Brett C. Jones, Broker Arrow, OK (US)

(73) Assignee: BAKER HUGHES INCORPORATED, Houston, TX (US)

( * ) Notice: Subject to any disclaimer, the term of this patent is extended or adjusted under 35 U.S.C. 154(b) by 364 days.

(21) Appl. No.: 14/464,139

(22) Filed: Aug. 20, 2014

(65) Prior Publication Data

US 2016/0053574 A1 Feb. 25, 2016

(51) Int. Cl.

| | |
|---|---|
| ***E21B 34/10*** | (2006.01) |
| ***E21B 37/06*** | (2006.01) |
| ***E21B 34/06*** | (2006.01) |

(52) U.S. Cl.

CPC ..... *E21B 34/063* (2013.01); *E21B 34/101* (2013.01)

(58) Field of Classification Search

CPC ..... E21B 34/10; E21B 41/02; E21B 37/06
See application file for complete search history.

(56) References Cited

U.S. PATENT DOCUMENTS

| | | | | |
|---|---|---|---|---|
| 4,042,033 | A * | 8/1977 | Holland | E21B 34/105 166/310 |
| 6,109,351 | A * | 8/2000 | Beall | E21B 34/10 166/321 |
| 6,148,920 | A * | 11/2000 | McCalvin | E21B 34/06 166/324 |
| 7,198,099 | B2 * | 4/2007 | Lugtmeier | E21B 34/105 166/115 |
| 7,708,075 | B2 * | 5/2010 | Lake | E21B 43/16 166/305.1 |

(Continued)

*Primary Examiner* — Kipp Wallace
(74) *Attorney, Agent, or Firm* — Cantor Colburn LLP

(57) ABSTRACT

A control system for a Subsurface Safety Valve (SSSV), includes an actuating piston mounted in a housing with at least one seal and connected to the SSSV. The actuating piston having a first end and a second end, the first end in fluid communication with a control line; a primary pressure reservoir in fluid communication with the second end of the actuating piston, the reservoir configured to contain a fluid under an amount of pressure selected to act against a prospective hydrostatic pressure expected in the control line based upon the selected position of the control system in a downhole environment. An equalizing piston in fluid communication with both the control line and with the second end of the actuating piston, the equalizing piston remaining in a closed position during shifting of the actuating piston with pressure applied or removed from the control line, the equalizing piston movable to an open position upon a control system failure that reduces pressure in the primary reservoir to below a threshold value; and a condition sensing and chemical injection assembly in fluid communication with the primary reservoir. A method for operating a control system for a Subsurface Safety Valve (SSSV).

16 Claims, 6 Drawing Sheets

(56) References Cited

U.S. PATENT DOCUMENTS

| | | | | |
|---|---|---|---|---|
| 8,016,035 | B2 * | 9/2011 | Strattan | E21B 34/105<br>166/250.08 |
| 2006/0157240 | A1 * | 7/2006 | Shaw | E21B 34/10<br>166/255.1 |
| 2006/0196539 | A1 * | 9/2006 | Raska | F16K 17/16<br>137/68.24 |
| 2010/0108320 | A1 * | 5/2010 | Larnach | E21B 41/02<br>166/310 |
| 2011/0192480 | A1 * | 8/2011 | Willauer | E21B 34/06<br>137/637 |

* cited by examiner

FAILSAFE CONTROL SYSTEM FOR A SAFETY VALVE HAVING A CONDITION SENSING AND CHEMICAL INJECTION FEATURE

BACKGROUND

Safety valves are ubiquitous in the downhole industry. Consequently, control systems number aplenty as well. In each case, the primary concern is that in the event of a failure of any part of the control system, the valve will either remain in or automatically proceed to a "safe" position. This may be open or closed depending upon the particular configuration.

Regardless of the number of presently available systems however, the art is generally receptive to alternative configurations with differing attributes and enhanced capabilities.

BRIEF DESCRIPTION

A control system for a Subsurface Safety Valve (SSSV), includes An actuating piston mounted in a housing with at least one seal and connected to the SSSV, the actuating piston having a first end and a second end, the first end in fluid communication with a control line; a primary pressure reservoir in fluid communication with the second end of the actuating piston, the reservoir configured to contain a fluid under an amount of pressure selected to act against a prospective hydrostatic pressure expected in the control line based upon the selected position of the control system in a downhole environment; an equalizing piston in fluid communication with both the control line and with the second end of the actuating piston, the equalizing piston remaining in a closed position during shifting of the actuating piston with pressure applied or removed from the control line, the equalizing piston movable to an open position upon a control system failure that reduces pressure in the primary reservoir to below a threshold value; and a condition sensing and chemical injection assembly in fluid communication with the primary reservoir.

A method for operating a control system for a Subsurface Safety Valve (SSSV) includes raising pressure in the control line in the system of claim 1 to a selected maximum working pressure; holding the maximum working pressure in the line and monitoring for pressure fall off; concluding that 1) the control system is operational if pressure is maintained for a selected period of time or that 2) the control system is not operational if pressure is not maintained for the selected period of time.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
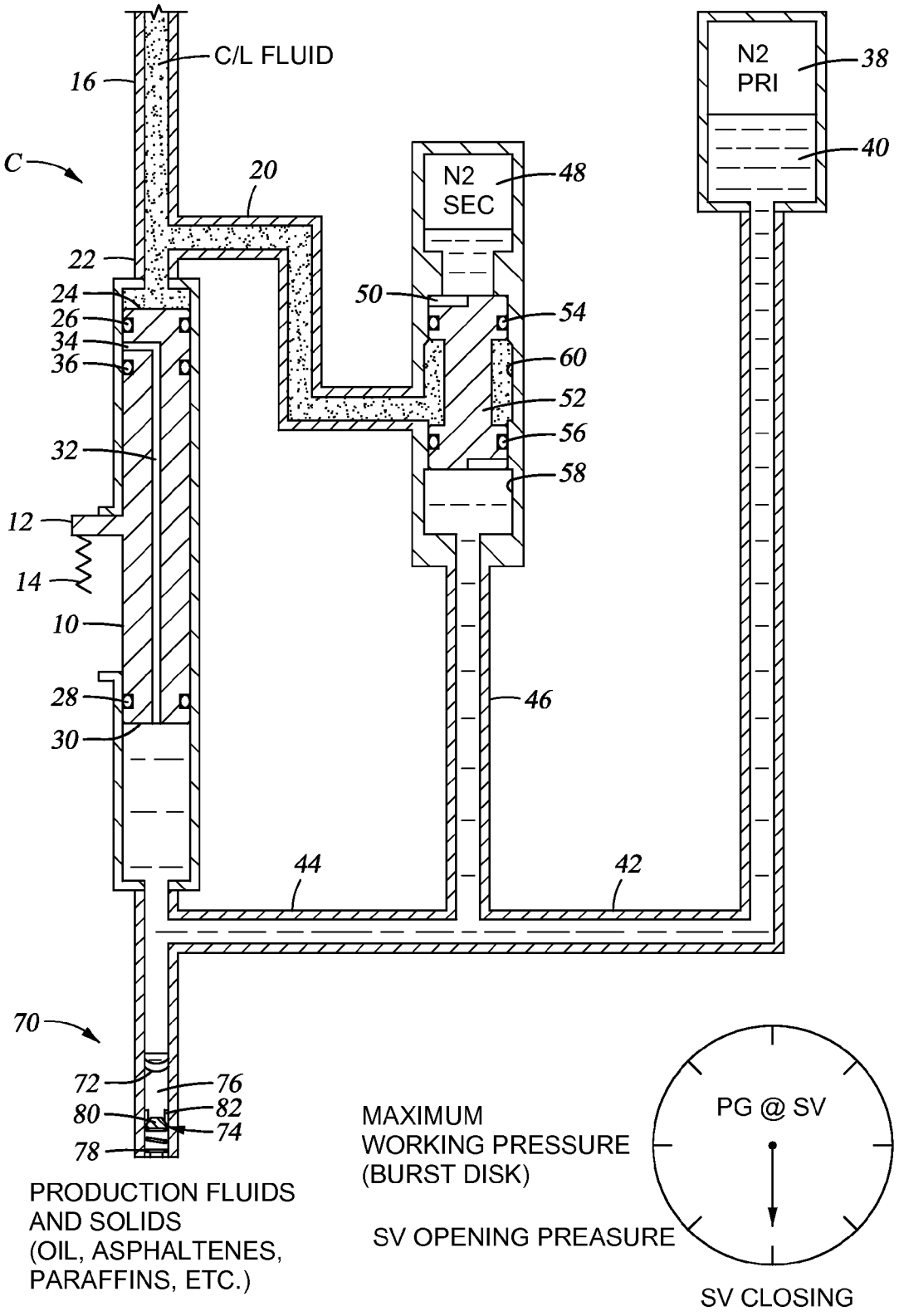
FIG. 1 is a schematic representation of a safety valve control system with the valve in a closed position and the control system operational.

The control system C is illustrated in FIG. 1. An actuation piston 10 is schematically illustrated as having an extension tab 12 on which a spring 14 acts to push the piston 10 to the position shown in FIG. 1. The tab 12 is connected to a flow tube (not shown) which in turn, when pushed down, swings a flapper (not shown) so as to open the passageway in a wellbore. The structure of the subsurface safety valve (SSSV) is not illustrated because it is common and well-known. The invention lies in the control system for the SSSV as opposed to the construction of the SSSV components themselves. Those skilled in the art will appreciate that the SSSV has a housing which can include many of the components of the control system C. The control system C is accessed from the surface of the wellbore by a control line 16 which runs from the surface of the wellbore to fluid communication with conduits 20 and 22. Conduit 22 opens up to top surface 24 of piston 10. Seal 26 prevents fluid in the control line 16 from bypassing around the piston 10. Another seal 28 is adjacent the lower end of the piston 10 near surface 30. Piston 10 has a passageway 32 which extends from surface 30 to an outlet 34 between seals 26 and 36. As such, the portion of piston 10 between seals 36 and 28 is exposed to the pressure in the housing of the SSSV as the piston 10 moves to a SSSV open position or an SSSV closed position.

A pressurized primary reservoir 38 contains a pressurized gas, preferably an inert gas such as nitrogen, above a level of hydraulic fluid 40 which communicates through a conduit 42 in turn to conduits 44 and 46. Conduit 44 allows the fluid 40 to exert a force against surface 30 of piston 10. The pressure in conduit 44 is communicated through passageway 32 to the area between seals 26 and 36. However, the pressure thus communicated through passageway 32 does not act to operate piston 10 during normal operations. In essence, passageway 32 constitutes a pressure leak path to ensure that the control system C puts the SSSV in a closed position if a failure occurs at seal 36.

Figure 2:
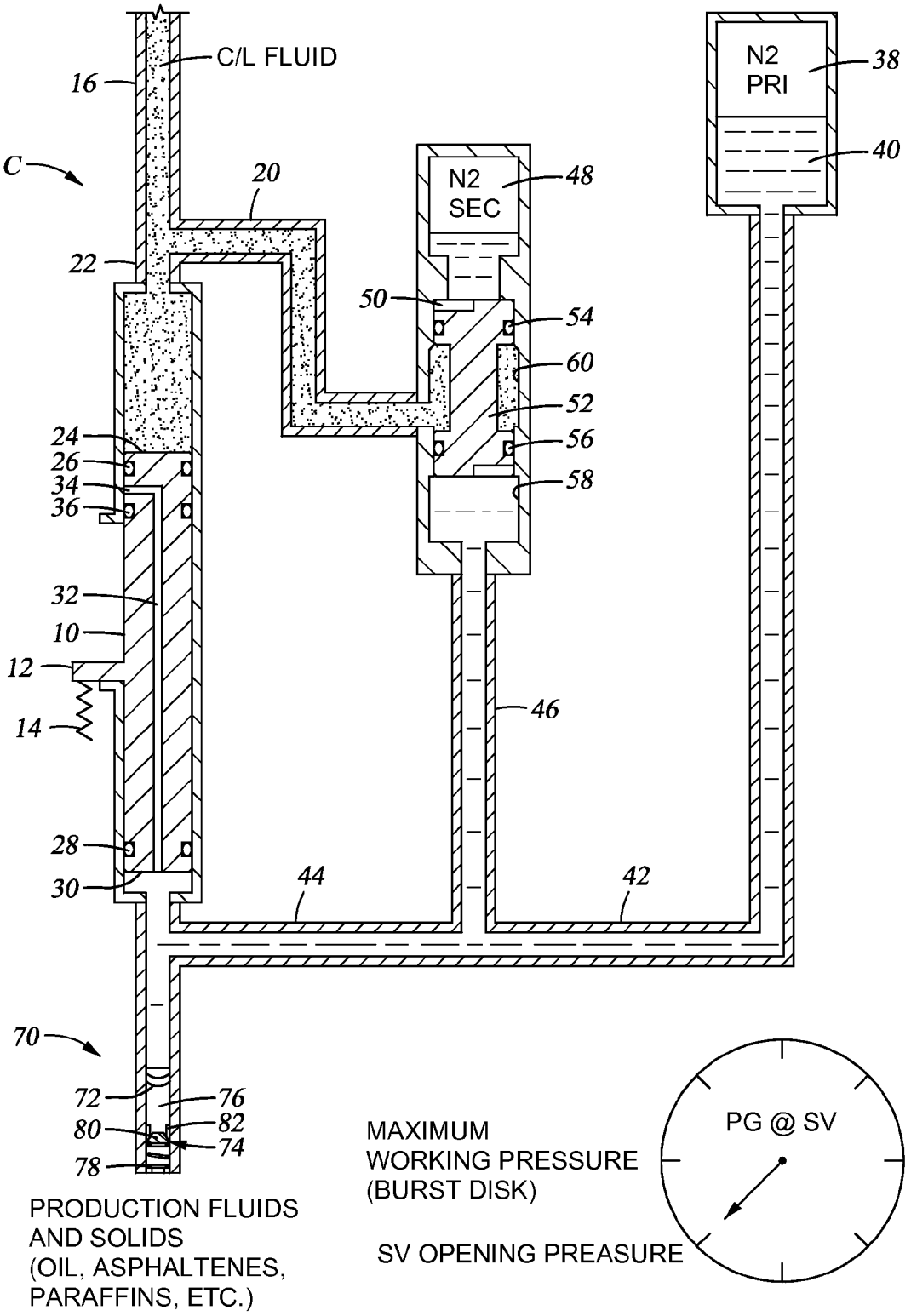
FIG. 2 is the system of FIG. 1 illustrated with the valve in an open position and the control system operational.
Figure 3:
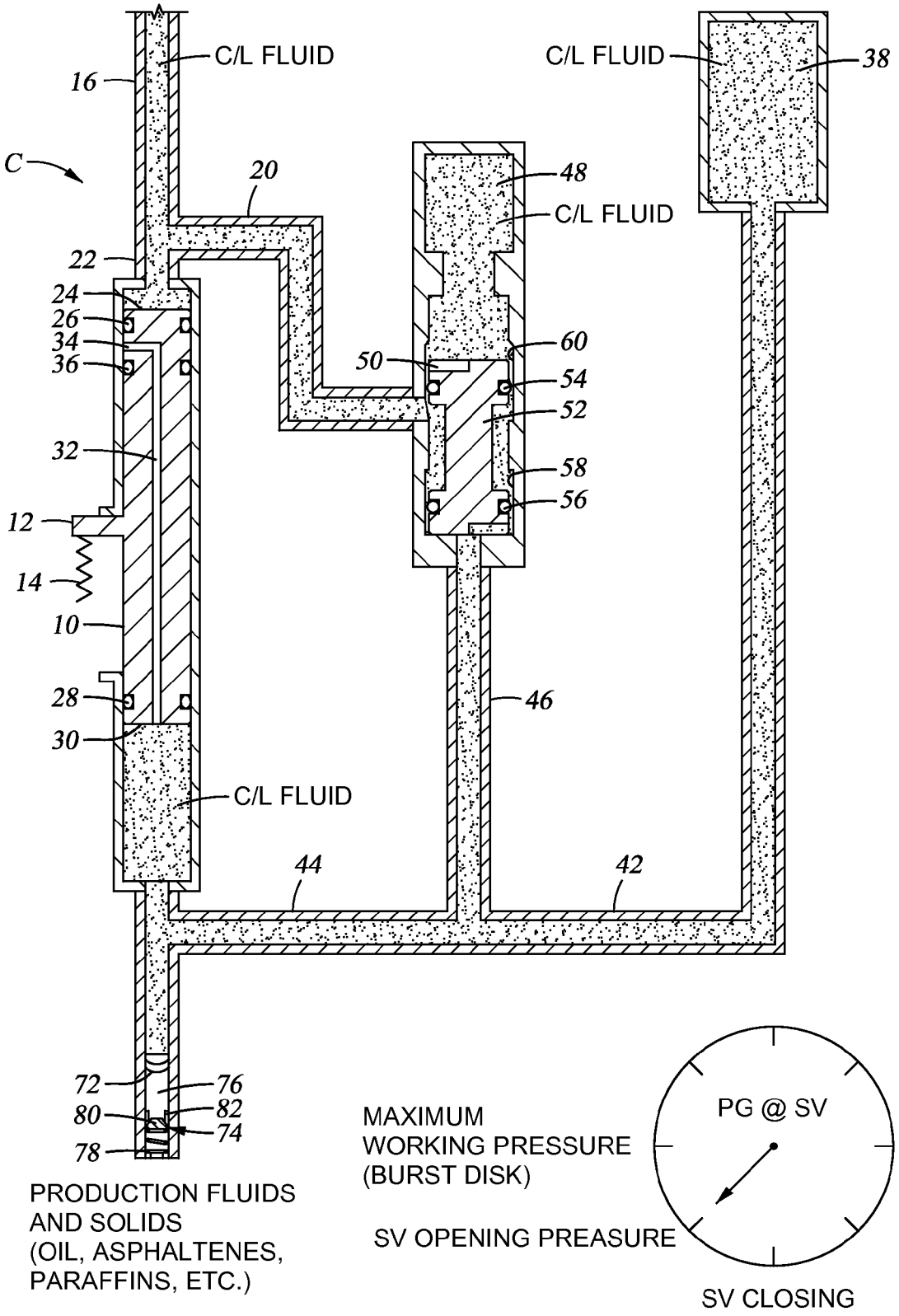
FIG. 3 is the system of FIG. 1 in a tripped condition where control line fluid is communicated to a primary reservoir.
Figure 4:
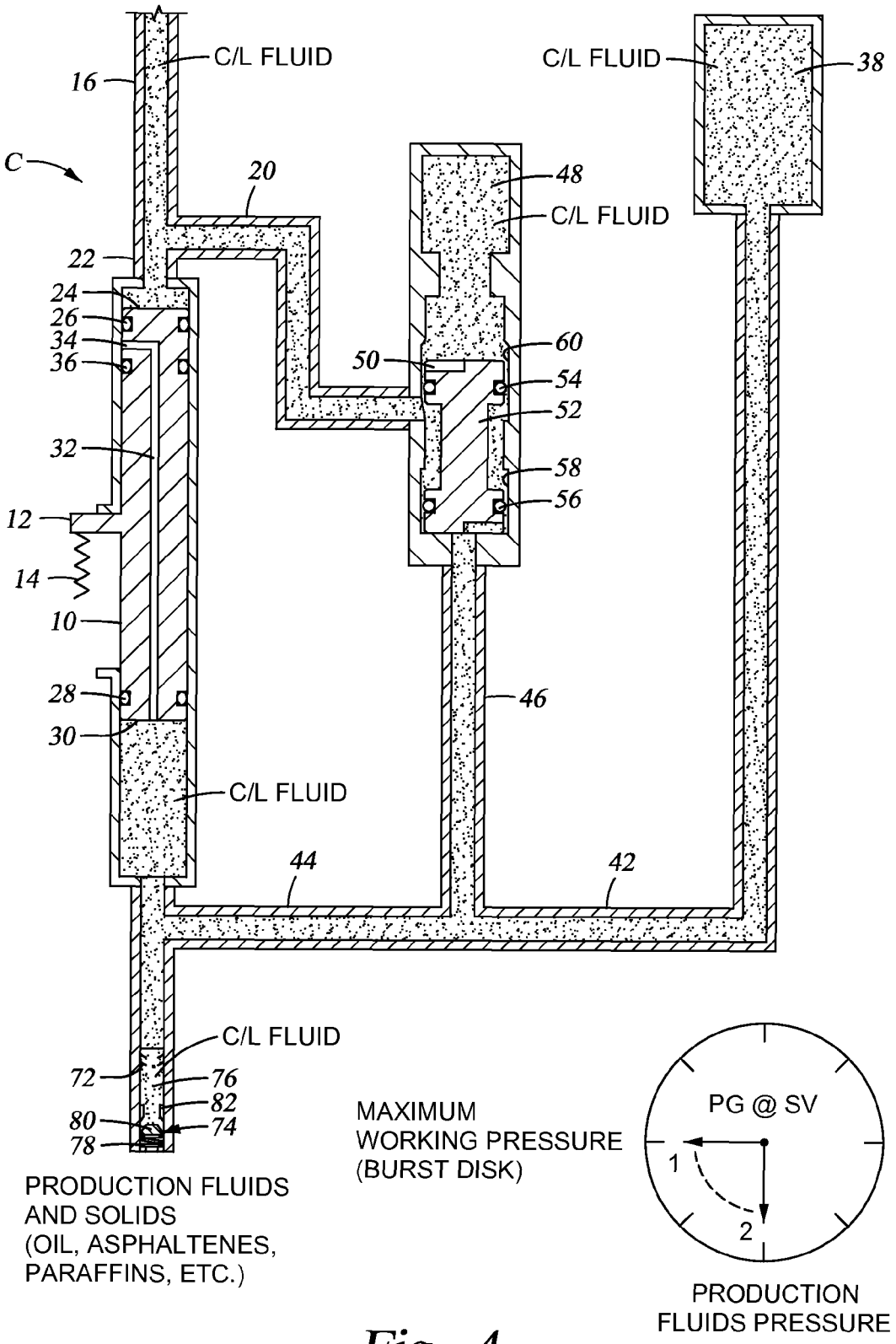
FIG. 4 is the system of FIG. 1 illustrated in a tripped condition with the condition and chemical injection assembly open.

A secondary reservoir 48 communicates with a surface 50 of an equalizing piston 52. A seal 54 isolates secondary reservoir 48 from conduit 20 in the position shown in FIG. 1. Seal 56, in the position shown in FIG. 1, isolates conduit 20 from conduit 46. Between conduit 46 and piston 52, as shown in FIG. 1, there is an enlarged bore 58. There's also an enlarged bore 60 below seal 54 in the position shown in FIG. 1. The purpose of the enlarged bores 58 and 60 is to permit bypass flow around the seals 54 and 56 after piston 52 shifts. Referring to FIG. 3, when the equalizing piston 52 shifts due to failure of a variety of different components as will be explained below, seal 56 no longer seals conduit 20 from conduit 46, thus allowing pressure from the control line 16 to equalize into conduit 44 and, hence, at the bottom 30 of the piston 10. It should be noted that seal 54 no longer seals reservoir 48 because it has moved into enlarged bore 60. When this happens, the piston 10 is in pressure balance and the return spring 14 can push the tab 12 upwardly, moving the piston 10 from the position shown in FIG. 2 where the SSSV is open, to the position in FIG. 3 where the SSSV is closed. It is to be appreciated that the particular configuration of the equalizing piston 52 and associated components is supplied for example only and that other arrangements for the system such as a ratcheting configuration that prevents equalizing piston 52 from repositioning after a trip condition are also contemplated for use in this disclosure. The ratcheting configuration as well as other arrangements in the tool are known from commercially available product families H82706, H82699, H82672 commonly referred to as the Neptune™ Performance series nitrogen-charged subsurface safety valve and available from Baker Hughes Incorporated Houston Tex.

The normal operation to open the SSSV using the control system C requires nothing more than applying pressure in the control line 16. It should be noted that the pressure in the primary reservoir 38 is above the hydrostatic pressure in the control line 16 from the hydraulic fluid therein in order to counteract the force presented thereby. In one embodiment, and arbitrarily, the value of the pressure in the primary reservoir 38 can be 500 psi above the anticipated hydrostatic pressure in the control line 16 at the depth at which the SSSV will be installed. Those skilled in the art will appreciate that the charges of pressure in primary reservoir 38, as well as secondary reservoir 48, need to be determined at the surface before the SSSV is installed. The pressure in the secondary reservoir 48 is to be below the prescribed pressure in the primary reservoir. In one embodiment and selected for convenience, the pressure used in the secondary reservoir 48 is 50 psi less than the anticipated control line hydrostatic pressure. The purpose of the primary reservoir 38 is to offset the hydrostatic force on piston 10 from control line 16. Piston 52 is normally under a pressure imbalance which is caused by the pressure difference between reservoirs 38 and 48. The hydrostatic or applied pressure in conduit 20 has no net force impact on piston 52.

Finally the reader's attention is directed to the bottom left corner of the figures where a condition sensing and chemical injection assembly 70 is illustrated. The assembly will be available for use at any time for condition sensing and under certain failure conditions of the control system C, for chemical injection repurposing of the control system C. The assembly 70 is to be positioned within the control system C to fluidly communicate between the primary reservoir 38 and the tubing components of the SSSV outside of the control system itself. The assembly comprises one or more burst disks 72, a one-way check valve 74 and an atmospheric chamber 76 between the one or more burst disks and the check valve. It is to be noted that in some embodiments atmospheric pressure may also be maintained between any two or more burst disks as well as between the burst disk nearest the check valve and the check valve itself. The check valve 74 comprises a spring 78 and a poppet head 80 that will seat in a seat 82 under influence of the spring 78 when control line pressure is not exceeding the spring force of spring 78 plus tubing pressure, to which the poppet head 80 is exposed at a side opposite the control line 16. The check valve 74 is openable based upon control line pressure being above the spring force plus tubing pressure (after the one or more burst disks have burst). The check valve 74 will reseat upon a control line pressure below tubing pressure and spring force.

It is to be understood that one burst disk 72 is sufficient for functionality of the assembly 70 but more than one will also work well and may provide for additional reliability in function. The atmospheric chamber 76 is important to ensure that the burst disk(s) burst ratings will be closely related to actual pressure differential numbers in situ. Were it not for the atmospheric chamber 76, the rating of the burst disk(s) would be subject to the variability of the tubing pressure (which very well might be above the control line maximum working pressure). With the atmospheric chamber 76, burst disks 72 may be rated to burst at the maximum working pressure of the control line, which rating will be close to constant. The bursting of the one or more burst disks will itself provide one of the condition indicators that is a benefit of the invention. More specifically, with the burst disk(s) rupturing at the maximum working pressure of the control line, a condition sensing function is realized. This will be better understood in the discussion hereunder.

The principal components of the control system having been described, its normal operation will now be reviewed. In order to actuate the SSSV from the closed position shown in FIG. 1 to the open position shown in FIG. 2, pressure is increased in control line 16. It should be noted that until the pressure in the control line 16 is elevated, the piston 10 is subject to a net unbalanced upward force from the pressure in primary reservoir 38 since it is 500 psi higher than the control line 16 hydrostatic pressure. However, upon sufficient elevation of pressure in the control line 16, to a level of approximately 2000 psi plus the primary nitrogen charge pressure in primary reservoir 38, a downward differential force exists across piston 10 which is great enough to overcome the applied upward forces resulting from the pressure in primary reservoir 38, as well as the force of the spring 14. When that occurs, the piston 10 moves downwardly, taking with it the flow tube (not shown), which in turn allows the spring-loaded flapper (not shown) to be rotated downwardly and out of the flowpath, thus opening the SSSV. The final position with the SSSV in the open position is shown in FIG. 2. As seen in FIG. 2, the piston 10 has traveled downwardly against the bias of spring 14 and tab 12, which is engaged to the flow tube, has moved the flow tube (not shown) down against the flapper to rotate the flapper (not shown) about 90° from its closed to its open position.

The closure of the SSSV occurs normally through a reversal of the procedure outlined above. The pressure in the control line 16 is reduced. When the pressure is sufficiently reduced, a net unbalanced upward force occurs on piston 10 due to the pressure in primary reservoir 38 acting on surface 30. This force, in combination with the force of spring 14, becomes greater than the hydrostatic force from the fluid column in the control line 16, thus allowing the piston 10 to move back upwardly to its position shown in FIG. 1. Reversal of movement occurs with respect to the flow tube and the flapper, allowing the SSSV to move to a closed position. It should be noted at this time that passageway 32 is a leak path whose purpose will be explained below. Although the pressure exerted from the gas in primary reservoir 38 acting on hydraulic fluid in lines 42 and 44 communicates with passage 32, the existence of passage 32 has no bearing on the net upward force exerted on piston 10. Accordingly, when seals 26 and 36 are in proper working order, there is simply a dead end to passageway 32 such that surface 30 of piston 10 acts as if it were a solid surface, making the net force applied by gas pressure in primary reservoir 38 act, through an intermediary fluid, on the full diameter of surface 30 during normal operations.

Potential problems can occur in the control system when the SSSV is in the closed position shown in FIG. 1 or when it is in the open position as shown in FIG. 2. These are detailed in U.S. Pat. No. 6,109,351, the entirety of which is incorporated by reference.

With more particular relevance to the present disclosure, the assembly 70 provides for two distinct benefits in the control system C as described above or in other control systems as well. Application of the disclosure below to other control systems will be understood by those of skill in the art following a thorough reading of the description below with reference to the figures. The benefits, as noted above are, 1) a condition sensing capability and 2) a chemical injection capability. The condition sensing capability employs maximum working pressure on the control line. The actual pressure can be whatever the design pressure of the control line 16 is since actual pressure is immaterial to the functionality of the configuration. The one or more burst disks 72 however will be rated to burst at substantially the same pressure as maximum working pressure of the control line 16. When an operator desires to check the condition of the SSSV and the control system C, pressure is raised within the control line to the maximum working pressure of the control line 16. If pressure can be maintained at maximum working pressure for a selected period of time, for example a few minutes, then the Control system C is functional. This is known from this exercise because if the pressure is maintainable, the control system has not communicated the control line to the primary reservoir portion of the system. Without this communication, control line pressure does not reach the one or more burst disks and hence cannot rupture the one or more burst disks. This provides a simple and rapid confirmation that the control system is still in working order. Conversely, if the system has indeed tripped meaning that control line pressure is communicated to the primary reservoir portion of the system, the one or more burst disks 72 will rupture at the control line maximum working pressure level. More specifically, in order for the one or more burst disks 72 to rupture, control line pressure must already have been communicated to the burst disk, which indicates a "tripped control system", a failure mode that results in control line pressure at both ends of the piston 10 so that spring 14 will close the SSSV. This condition is fully described in the above incorporated patent. If the system is tripped then raising control line pressure to maximum working pressure will result in the pressure at the one or more bursts disks being at the same maximum working pressure. If, as noted is the case, the one or more burst disks are rated to rupture at the maximum working pressure of the control line, they will rupture when pressure reaches that value. Once the one or more disks rupture, pressure in the control line will begin to fall. In this situation, it will not be possible to maintain the maximum pressure for the prescribed period of time, thereby providing the operator with a positive indication that the control system C has tripped. In the event that the above described testing for condition has been undertaken in relation to an SSSV not moving scenario, the operator can be confident that either the valve is physically stuck with scale, paraffin, etc. or the control system has tripped. If the valve is physically stuck, interventions would then be indicated to exercise the SSSV. If the system is tripped however, different actions would be indicated. In one desirable iteration, the control system as described is duplicated in an entirely redundant secondary control system and accordingly upon a confirmation of a tripped control system, the secondary control system would be used to attempt actuation of the SSSV without the need for a separate run of tools to exercise the SSSV. The configuration as described avoids separate runs to determine the cause of a valve not moving condition, reducing the total number of interventional activities to those situations where they are actually needed.

Another aspect of the invention described herein is the repurposing of the control system C to be used as a chemical injection system if indeed the test described above identifies a tripped condition (a control system failure). Heretofore, a control system failure simply meant that the control system had no continuing utility for the operator and a backup system would be utilized. Configured as taught herein however, the control system may be further operated as a chemical injection system. Moreover, the chemicals injected by the system will be placed more advantageously than prior art methods. In particular, where a tripped condition has occurred and the one or more burst disks have burst as described above, the hydraulic fluid from the control system will leak into areas surrounding the components of the SSSV behind the flow tube (locations will be understandable to one of skill in the art). Because the control system has the ability to supply fluid to that location through the burst disks and check valve 74 greater chemical action of a chemical injection fluid would be realized. In particular, the control line fluid is swapped out for chemical injection fluid. Normally this would be done by simply pushing the control fluid past the check valve and continuing to pump fluid until a sufficient amount of the chemical injection fluid has reached the SSSV. The configuration as such, renders a heretofore useless system (having been tripped) a newly useful system in a repurposed way. Because of the location of the supply of chemical injection fluid as noted above, the result is even better than prior art such as chemical injection fluid run on a tubing string of some kind since the injection fluid goes directly to the components of the valve that will most benefit from its presence.

Figure 5:
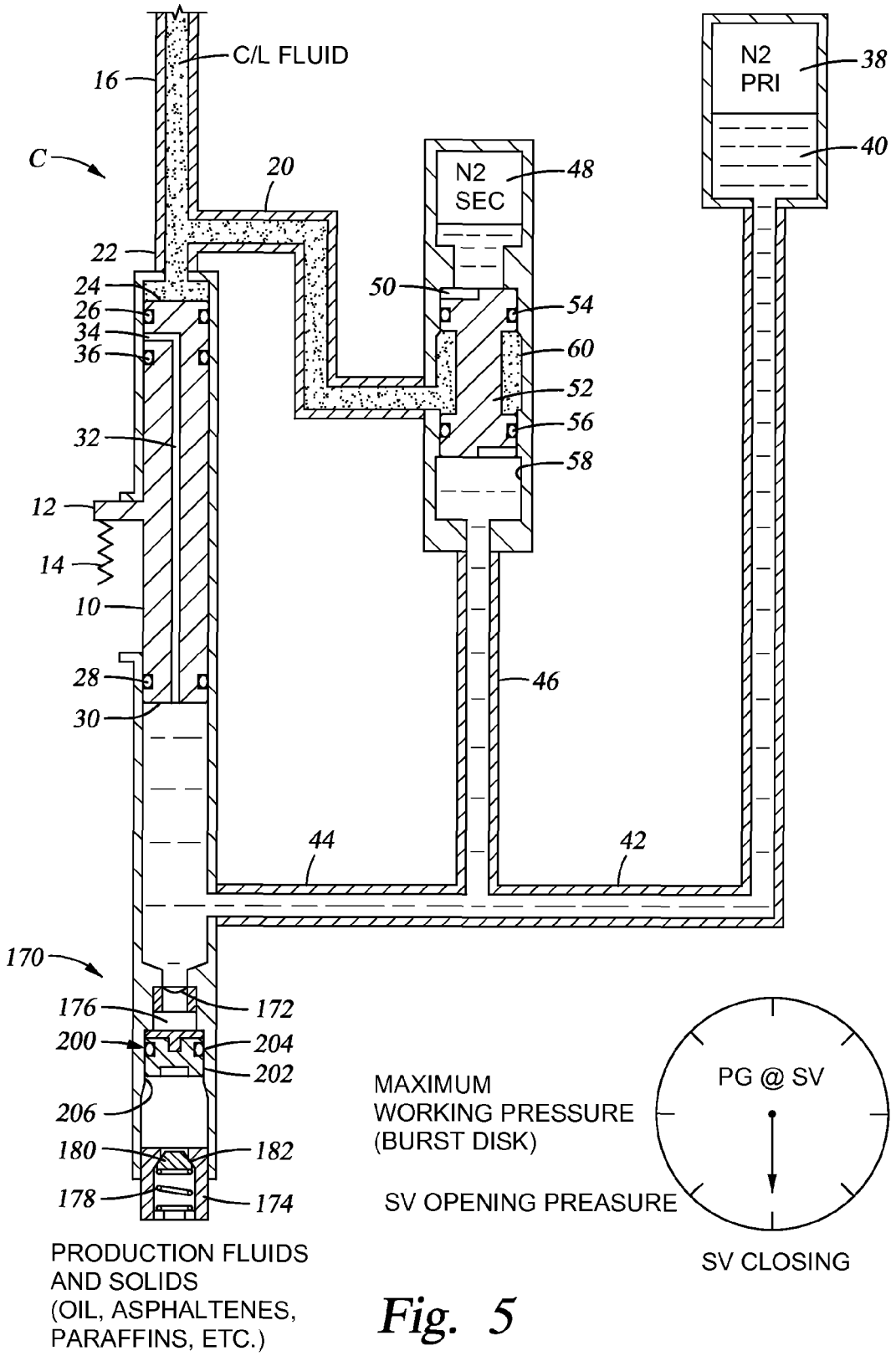
FIG. 5 is an enlarged view of an alternate embodiment of the condition sensing and chemical injection assembly illustrated in the area of FIG. 1 circumscribed at 5-5.
Figure 6:
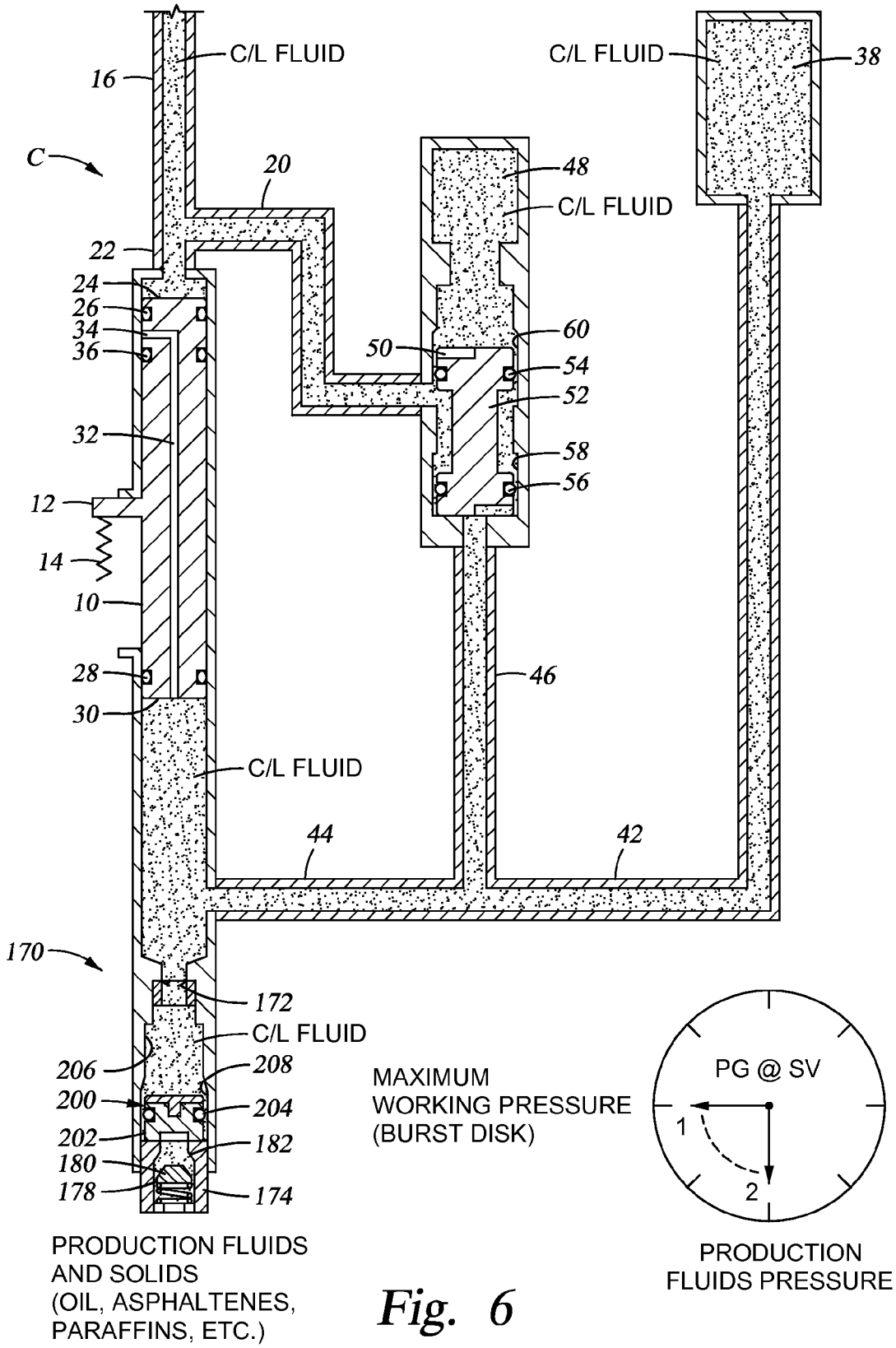
FIG. 6 is the view of FIG. 5 in an actuated condition.

Referring to FIGS. 5 and 6, an alternate embodiment of the condition sensing and chemical injection assembly is illustrated. The illustrations are similar to FIGS. 1-4 but for the lower left corner of each figure where the condition sensing and chemical injection assembly may be viewed. The assembly 170 of FIGS. 5 and 6 replaces assembly 70 of FIG. 1. Some of the components are similar and hence are given 100 series numerals of those found in FIGS. 1-4. These include one or more burst disks 172, check valve 174, atmospheric chamber 176, spring 178, poppet head 180, and seat 182. Differing from FIGS. 1-4 however, is seal insert 200 which provides for an even more reliable atmospheric chamber 176 between the one or more burst disks 172 and the balance of the assembly 170 (this embodiment also may include additional atmospheric chambers between any two of the burst disks. The seal insert 200 comprises a piston like body 202 supporting a seal 204 such as an o-ring. The o-ring 204 seals against an inside diameter of a housing 206 of the assembly 170. The seal insert 200 provides for a movable positive seal in a first position and in a second position, illustrated in FIG. 6, where the housing 206 has a larger inside diameter area 208 that is too large for the seal insert 200 to seal. Hence, fluid may flow around the seal insert 200 and act upon check valve 174 as described in the embodiment described above.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A control system for a Subsurface Safety Valve (SSSV), comprising:

an actuating piston mounted in a housing with at least one seal and connected to the SSSV, the actuating piston having a first end and a second end, the first end in fluid communication with a control line;

a primary pressure reservoir in fluid communication with the second end of the actuating piston, the reservoir configured to contain a fluid under pressure;

an equalizing piston in fluid communication with both the control line and with the second end of the actuating piston, the equalizing piston remaining in a closed position during shifting of the actuating piston with pressure applied or removed from the control line, the equalizing piston movable to an open position upon a control system failure that reduces pressure in the primary reservoir to below a threshold value; and a condition sensing and chemical injection assembly in fluid communication with the primary reservoir and the second end of the actuating piston, wherein the closed position of the equalizing piston blocks fluid communication between the control line and the condition sensing and chemical injection assembly, and the open position of the equalizing piston permits fluid communication between the condition sensing and chemical injection assembly and the control line.

2. The control system of claim 1, wherein the condition sensing and chemical injection assembly includes one or more burst disks.

3. The control system of claim 1, wherein condition sensing and chemical injection assembly includes a check valve.

4. The control system of claim 1, wherein condition sensing and chemical injection assembly includes a seal insert.

5. The control system of claim 3, wherein the check valve includes a poppet head and a spring urging the poppet head to a closed position, the spring acting in a direction opposing the control line.

6. The control system of claim 1, wherein the condition sensing and chemical injection assembly includes an atmospheric chamber disposed between two or more burst disks.

7. The control system of claim 1, wherein the condition sensing and chemical injection assembly includes an atmospheric chamber disposed between one or more burst disks and a check valve.

8. The control system of claim 1, wherein the condition sensing and chemical injection assembly includes an atmospheric chamber disposed between one or more burst disks and a seal insert.

9. The control system of claim 1, wherein the pressure in the primary pressure reservoir acts against pressure on the first end of the actuating piston.

10. The control system of claim 1, wherein the condition sensing and chemical injection assembly is configured to inject directly to components of the SSSV behind a flow tube of the SSSV.

11. The control system of claim 2, wherein at least one of the one or more burst disks is rated to burst at substantially a same pressure as a maximum working pressure of the control line.

12. A method for operating a control system for a Subsurface Safety Valve (SSSV) comprising:

raising pressure in the control line in the system of claim 1 to a selected maximum working pressure;

holding the maximum working pressure in the line and monitoring for pressure fall off;

concluding that 1) the control system is operational if pressure is maintained for a selected period of time or that 2) the control system is not operational if pressure is not maintained for the selected period of time.

13. The method for operating a control system of claim 12 further comprising repurposing the control system if the concluding is that the control system is not operational.

14. The method for operating a control system of claim 13 wherein the repurposing is swapping the control line fluid for a chemical injection fluid.

15. The method for operating a control system of claim 14 further comprising injecting the chemical injection fluid through the condition sensing and chemical injection assembly to components of the SSSV.

16. The method for operating a control system for a Subsurface Safety Valve (SSSV), the control system comprising:

an actuating piston mounted in a housing with at least one seal and connected to the SSSV, the actuating piston having a first end and a second end, the first end in fluid communication with a control line;

a primary pressure reservoir in fluid communication with the second end of the actuating piston, the reservoir configured to contain a fluid under pressure;

an equalizing piston in fluid communication with both the control line and with the second end of the actuating piston, the equalizing piston remaining in a closed position during shifting of the actuating piston with pressure applied or removed from the control line, the equalizing piston movable to an open position upon a control system failure that reduces pressure in the primary reservoir to below a threshold value; and a condition sensing and chemical injection assembly in fluid communication with the primary reservoir;

the method comprising:

raising pressure in the control line in the system to a selected maximum working pressure;

holding the maximum working pressure in the line and monitoring for pressure fall off;

concluding that 1) the control system is operational if pressure is maintained for a selected period of time or that 2) the control system is not operational if pressure is not maintained for the selected period of time; and, repurposing the control system if the concluding is that the control system is not operational, the repurposing including swapping the control line fluid for a chemical injection fluid, injecting the chemical injection fluid through the condition sensing and chemical injection assembly to components of the SSSV, wherein the injecting is directly to components of the SSSV behind a flow tube of the SSSV.

* * * * *